US010464129B2

(12) United States Patent
Collura

(10) Patent No.: US 10,464,129 B2
(45) Date of Patent: Nov. 5, 2019

(54) SELF-SUPPORTED LADLE SHROUD FOR REVERSIBLE COUPLING TO A CONNECTOR NOZZLE

(71) Applicant: VESUVIUS GROUP S.A., Ghlin (BE)

(72) Inventor: Mariano Collura, Strepy-Bracquegnies (BE)

(73) Assignee: VESUVIUS GROUP S.A., Ghlin (BE)

( * ) Notice: Subject to any disclaimer, the term of this patent is extended or adjusted under 35 U.S.C. 154(b) by 0 days.

(21) Appl. No.: 16/011,986

(22) Filed: Jun. 19, 2018

(65) Prior Publication Data

US 2018/0297111 A1 Oct. 18, 2018

Related U.S. Application Data

(62) Division of application No. 15/029,287, filed as application No. PCT/EP2014/071865 on Oct. 13, 2014, now Pat. No. 10,046,390.

(30) Foreign Application Priority Data

Oct. 14, 2013 (EP) ..... 13188595

(51) Int. Cl.
*B22D 41/50* (2006.01)
*F27D 3/14* (2006.01)
*B22D 41/56* (2006.01)

(52) U.S. Cl.
CPC ..... *B22D 41/502* (2013.01); *B22D 41/56* (2013.01); *F27D 3/14* (2013.01)

(58) Field of Classification Search
CPC ..... B22D 41/502; B22D 41/56; F27D 3/14
USPC ..... 266/236; 222/600, 607, 591, 594, 597; 164/474, 475, 418, 437, 335, 227
See application file for complete search history.

(56) References Cited

U.S. PATENT DOCUMENTS

| | | | |
|---|---|---|---|
| 3,460,725 | A | 8/1969 | Karl-Heinz Golde et al. |
| 4,079,869 | A | 3/1978 | Meier et al. |
| 4,262,827 | A | 4/1981 | Demasi et al. |
| 4,593,838 | A | 6/1986 | Oberbach et al. |
| 4,854,488 | A | 8/1989 | Trenkle et al. |
| 5,219,515 | A | 6/1993 | Chabot et al. |
| 5,351,865 | A | 10/1994 | Szadkowski et al. |
| 5,772,908 | A | 6/1998 | Richard |

(Continued)

FOREIGN PATENT DOCUMENTS

| | | |
|---|---|---|
| CN | 1057798 | 1/1992 |
| CN | 2560456 Y | 7/2003 |

(Continued)

*Primary Examiner* — Jessee R Roe
*Assistant Examiner* — M. A.
(74) *Attorney, Agent, or Firm* — Thomas Clinton; Donald M. Satina

(57) ABSTRACT

A ladle shroud is fixed to a coupling device for reversibly coupling an inlet orifice of said ladle shroud to a collector nozzle fixed to the outside of a bottom floor of a ladle in a metal casting installation, by means of at least a first and second elongated latch pivotally mounted on a hinge, such that the latch can pivot from a fixing position to an idle position. The idle position of the latches allows the engagement of the ladle shroud into its casting configuration about the collector nozzle, and the fixing position of the latches engages catches provided on said latches into matching fasteners located on the gate frame holding the collector nozzle.

1 Claim, 11 Drawing Sheets

(56) References Cited

U.S. PATENT DOCUMENTS

| | | | | |
|---|---|---|---|---|
| 8,127,972 | B2 | 3/2012 | Hanse et al. | |
| 8,272,427 | B2 * | 9/2012 | Hanse | B22D 11/106 164/437 |
| 10,046,390 | B2 * | 8/2018 | Collura | B22D 41/502 |
| 2011/0248055 | A1 * | 10/2011 | Collura | B22D 11/106 222/590 |
| 2011/0278331 | A1 | 11/2011 | Boisdequin et al. | |
| 2013/0008927 | A1 * | 1/2013 | Boisdequin | B22D 41/34 222/591 |

FOREIGN PATENT DOCUMENTS

| | | | |
|---|---|---|---|
| CN | 1697714 | | 11/2005 |
| JP | S54148625 | U | 10/1979 |
| JP | H0596363 | | 4/1993 |
| JP | H05508348 | | 11/1993 |
| JP | H09108825 | A | 4/1997 |
| JP | H09201657 | A | 8/1997 |
| JP | H10211570 | A | 8/1998 |
| JP | 2008296233 | A | 12/2008 |
| JP | 2012509184 | | 4/2012 |
| RU | 2150349 | | 6/2000 |
| SU | 846077 | | 7/1981 |
| SU | 1553241 | | 3/1990 |
| WO | 2008071327 | A1 | 6/2008 |
| WO | 2011113596 | | 9/2011 |

* cited by examiner

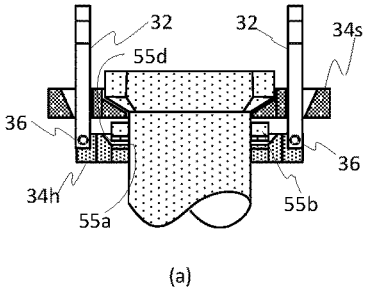
FIG.15A
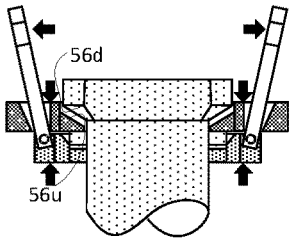
FIG.15B
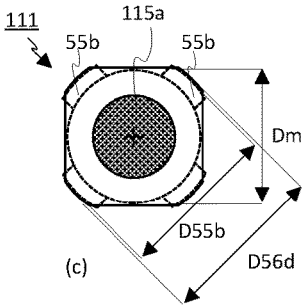
FIG.15C
FIG.15D
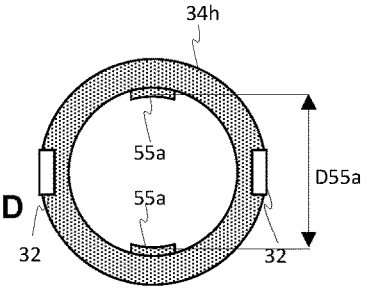
FIG.15G
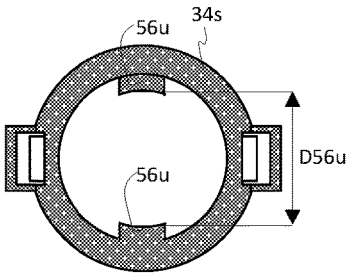
FIG. 15E
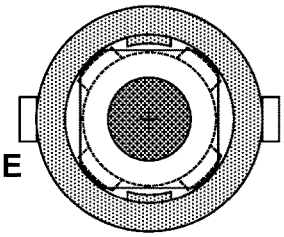
FIG.15H
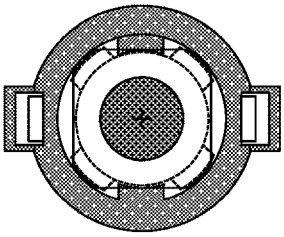
FIG.15F
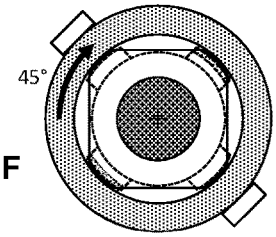
FIG.15I
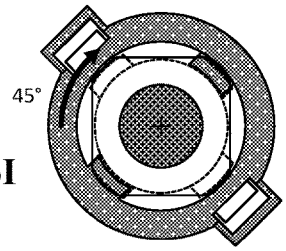

SELF-SUPPORTED LADLE SHROUD FOR REVERSIBLE COUPLING TO A CONNECTOR NOZZLE

CROSS-REFERENCE TO RELATED APPLICATIONS

The present application is a divisional application of U.S. Ser. No. 15/029,287, filed Apr. 14, 2016, and issued as U.S. Pat. No. 10,046,390 on Aug. 14, 2018, which is a national stage application submission under 35 U.S.C. 371 of PCT/EP2014/071865, filed 13 Oct. 2014, which was an international application claiming priority from EP 13188596.5, filed 14 Oct. 2013.

BACKGROUND OF THE INVENTION a. Field of the Invention

The present invention relates to shroud nozzles to be coupled to a ladle in a metal casting installation for shielding from contact with air the molten metal flowing out of the ladle into a tundish. Such nozzles are commonly referred to as ladle shrouds. In particular, it relates to a coupling device for holding a ladle shroud in casting position with respect to a collector nozzle jutting out of the bottom floor of a ladle without any external means. The present invention also concerns a ladle shroud to be used with such coupling device and concerns a metal casting installation comprising both ladle shroud and coupling device.

b. Description of the Related Art

In metal forming processes, metal melt is transferred from one metallurgical vessel to another, to a mould or to a tool. For example, as shown in FIG. 1 a ladle (11) is filled with metal melt out of a furnace (not shown) and transferred to a tundish (10) through a ladle shroud (111) extending from the ladle to the interior of the tundish for protecting the molten metal from contact with air. The metal melt can then be cast through a pouring nozzle (101) from the tundish to a mould (100) for forming slabs, billets, beams or ingots. Flow of metal melt out of a metallurgic vessel is driven by gravity through a nozzle system (101, 111) located at the bottom of said vessel.

In particular, the ladle (11) is provided at the inner surface of its bottom floor with an inner nozzle (113). Said inner nozzle is aligned with a collector nozzle (112) jutting out of the outer surface of said bottom floor, and is separated therefrom by a gate (114), generally a sliding gate (linear or rotary), allowing the bringing of the inner nozzle in or out of fluid communication with the collector nozzle, to start or stop casting metal, respectively. In order to protect the molten metal from oxidation as it flows from the ladle to a tundish (10), a ladle shroud (111) is interposed between the collector nozzle and the top surface of the molten metal contained in the tundish, penetrating deep into the tundish. A ladle shroud is simply a long tube with a central bore, which inlet is suitable for snugly nesting the outer surface of the collector nozzle in a casting configuration wherein a seal Is formed between the outer surface of the collector nozzle (112) and the inner surface of the bore inlet orifice of the ladle shroud (111).

In practice, a ladle is brought to its casting position over a tundish or a mould from a furnace where it was filled with a new batch of molten metal, with the gate (114) in a closed configuration. During its trips from the furnace to the casting position and back, the ladle is not coupled to any ladle shroud because the latter is too long and juts out too dangerously to be travelling to and fro across a steel plant. Once the ladle is in its casting position, a robot (20) or other handling tool brings a ladle shroud (111) into casting configuration with the collector nozzle (112) snugly nested in the bore inlet of the ladle shroud (cf. FIGS. 1&2). In traditional casting installations, the robot (20) also maintains the ladle shroud in its casting configuration during the whole casting of the molten metal batch contained in the ladle. When the ladle is empty, the gate is closed and the robot retrieves the ladle shroud from the collector nozzle to allow the removal of the empty ladle (11) and replacement by another ladle filled with a new batch of molten metal. The robot (20) repeats the foregoing operations with the new ladle.

Emergencies may happen, with the gate not functioning properly, requiring the swift removal of the ladle from its casting position and emptying of its content of molten metal into an appropriate emergency waste area. If the ladle shroud is coupled to the collector nozzle of the ladle with the robot firmly gripping the former in its casting configuration, the emergency removal of the ladle will drag therewith both ladle shroud and robot, causing serious damages to the installation. Indeed, the robot cannot be dragged very far, and the ladle may be blocked halfway, casting molten metal in an inappropriate area of the workshop causing serious consequences and danger.

To prevent such accidents to occur, ladle shrouds comprising means for holding them in casting configuration without the need of a robot have been proposed in the art. This way, the swift removal of a ladle would certainly break the ladle shroud, but would not drag and be stopped by a bulky (and expensive) robot in its emergency removal run.

For example, JP09-2011657 proposes a nozzle provided with coupling means including a bayonet requiring the rotation of the nozzle about its longitudinal axis to block it in its casting configuration. Such rotation can become very difficult as soon as the slightest amount of metal melt flows into and jags the bayonet mechanism upon freezing. Alternatively, JP09-1008825 proposes a nozzle comprising two long pins on either side thereof suitable for being held in casting configuration by a moving bracket comprising complementary slots for receiving said pins. This mechanism requires much room at one side of the ladle to function and necessitates an excellent coordination between the loading of a ladle shroud nozzle onto the slots of the brackets, and the tilting of the latter in a clamping configuration.

It certainly remains a need in the art for ladle shrouds which can hold themselves in their casting configuration without the assistance of a robot or any other external assistance, which are simple and financially competitive, which require little coordination and with moving parts well away from the interface between inlet of the bore of the ladle shroud and the outer surface of the collector nozzle, to prevent jagging thereof by frozen metal. These and other advantages of the present invention are presented in the following sections.

BRIEF SUMMARY OF THE INVENTION

The present invention is defined in the appended independent claims. Preferred embodiments are defined in the dependent claims. In particular, the present invention concerns a coupling device for reversibly coupling an inlet orifice of a ladle shroud to a collector nozzle fixed to the outside of a bottom floor of a ladle in a metal casting installation, said coupling device comprising:

(a) a hinge frame having a central opening normal to a longitudinal axis, X1, passing through the centroid of said opening, and which is suitable for receiving, or configured to receive, a ladle shroud;

(b) shroud connecting means, or coupling device shroud connector, for connecting, or configured to connect, said hinge frame to a ladle shroud inserted in said central opening;

(c) at least a first and second elongated latches comprising a distal end and a proximal end, and wherein each of the at least first and second latches:

is pivotally mounted on a hinge at a level closer to the distal end than to the proximal end of the latch, said hinge being located on the hinge frame, such that the latch can pivot from a fixing position to an idle position, is coupled to resilient means, or a latch driver, naturally biased to drive said latch to its fixing position, is provided with a catch, or catching means, located closer to the proximal end than to the distal end of the latch, wherein said catching means may comprise either an opening in the latch, or a lug extending transverse to the latch.

such that the pivoting of anyone of the at least first and second latches about its respective hinge from its respective idle position to its respective fixing position reduces the distance separating the catching means thereof from the centroid of the central opening.

It is preferred that each hinge allows, or is configured to permit, the corresponding latch to pivot within a plane including said longitudinal axis, X1, and about a hinge axle normal to the longitudinal axis, X1. In a first embodiment of the present invention, each hinge can be located adjacent to, or at the distal end of the corresponding latch and each latch engages a slot of geometry such that the displacement along a direction parallel to the longitudinal axis, X1, of said slot relative to said hinge moves said latch between the idle position and the fixing position thereof. It is preferred that all the slots in which the corresponding latches are engaged be provided on a slot frame which can be moved (with respect to the hinge frame (34*h*)) along the longitudinal axis, X1, between a first position and a second position, wherein the distance between the slot frame (34*s*) and hinge frame (34*h*) is greater in the first position than in the second position, the resilient means being biased and mounted such that the slot frame is driven towards the position thereof corresponding to the fixing position of the latches. It is preferred that the fixing position of the latches corresponds to the first position of the slot frame.

In a second embodiment of the present invention, each hinge is located between the proximal end and the distal end of the corresponding latch, such that said latch can pivot, or is configured to pivot, in a see-saw mode from its fixing position to its idle position by applying onto its distal end a force normal to both the hinge axle and the longitudinal axis, X1, and in the direction of the latter (the longitudinal axis, X1).

At least two latches are required to solidly couple a ladle shroud to a ladle. It is clear, however, that more than two latches can be provided in a coupling device according to the present invention. For example, the coupling device may comprise two, three or four latches evenly distributed around a perimeter of the hinge frame.

The present invention also concerns a ladle shroud suitable for being coupled to a coupling device as defined above. A ladle shroud according to the present invention comprises:

(a) an inlet portion located at an upstream end of the nozzle and comprising:

i) an upstream surface normal to a longitudinal axis, X1, and defining an upstream perimeter, said upstream surface being provided with an inlet orifice suitable for snugly fitting, or configured to snugly fit, a collector nozzle coupled to a ladle; and ii) a peripheral wall surrounding said upstream perimeter and extending along said longitudinal axis, X1, said peripheral wall being at least partially lined with a metal can, (b) a tubular portion extending along said longitudinal axis, X1, from said inlet portion to a downstream end, opposite the upstream end, and where an outlet orifice is located, (c) a bore extending parallel to the longitudinal axis, X1, from said inlet orifice to said outlet orifice, characterized in that, it further comprises device connecting means for connecting with the shroud connecting means of a coupling device as defined above, said device connecting means being in the form of at least a first and a second discrete protrusions, which are part of the metal can and are evenly distributed around the perimeter of the peripheral wall, wherein each of said at least first and second protrusions has a width, W, in the direction tangential to the peripheral wall and normal to the longitudinal axis, X1, and a depth, d, in the radial direction normal to the width, W, and to the longitudinal axis, X1, such that $d/W<1$, and defines an upstream ledge, facing the direction of the upstream end of the ladle shroud, and a downstream ledge, facing the direction of the downstream end of the ladle shroud, wherein the downstream ledge is convex with an apex facing towards the downstream end of the ladle shroud and is located in the middle of, or substantially in the middle of, the protrusion's width, W. The downstream ledge is preferably in the shape of a chevron or of a circular arc.

In the present text, the terms "upstream" and "downstream" are defined with respect to the flow direction of molten metal when the ladle shroud is in casting configuration with the collector nozzle and the gate is open.

The present invention also concerns a kit of parts comprising a coupling device and a ladle shroud as defined above, wherein the shroud connecting means of the coupling device comprise at least a first and second concave upstream ledges located within the central aperture of the coupling device, facing towards the upstream orifice and positioned and of geometry such that, when the inlet portion of the ladle shroud is inserted in the central aperture of the coupling device, the convex downstream ledges of the protrusions of the ladle shroud can rest, or are configured to rest, in matching relationship on the concave upstream ledges of the shroud connecting means of the coupling device. In a preferred embodiment, bringing the convex downstream ledges of the protrusions of the ladle shroud to rest in matching relationship on the concave upstream ledges of the shroud connecting means of the coupling device can be achieved by inserting the ladle shroud into the central opening of the coupling device and moving the latter along the longitudinal axis in the direction of the outlet orifice to a pre-set position, whence the coupling device is rotated about the longitudinal axis, until (or so that) the convex downstream ledges of the protrusions of the ladle shroud are vis-à-vis and can rest onto the concave upstream ledges of the shroud connecting means of the coupling device.

If the coupling device comprises a hinge frame and a slot frame as defined above, it is preferred that the concave upstream ledges of the shroud connecting means be provided on the hinge frame, and that the slot frame comprises downstream ledges opposite the concave upstream ledges of the hinge frame and matching the geometry of the upstream ledges of the protrusions of the ladle shroud, such that:

(a) the pre-set position until which the coupling device is to be moved along the longitudinal axis corresponds to a position wherein the protrusions of the ladle shroud are at a level comprised between the concave upstream ledges of the hinge frame and the downstream ledges of the slot frame, when the latter is in its first position with respect to the hinge frame (=away therefrom), thus allowing the rotation of the coupling device about the longitudinal axis, X1, until the protrusions of the ladle shroud are located between the downstream ledges of the slot frame and the concave upstream ledges of the hinge frame, and (b) when the slot frame (34*s*) is in its second position with respect to the hinge frame (i.e., close thereto), the protrusions (55*b*) of the ladle shroud are clamped between the upstream ledges of the hinge frame and the downstream ledges of the slot frame.

The kit of parts preferably also comprises a collector nozzle comprising a bore extending from an inlet at one end of the collector nozzle and opening at an opposite outlet end, said outlet end being suitable for snugly fitting, or configured to snugly fit, into the inlet orifice of the ladle shroud in a casting configuration whereby a continuous casting bore is formed extending along the longitudinal axis, X1, from the inlet of the collector nozzle to the outlet orifice of the ladle shroud. The collector nozzle is coupled to a ladle through a gate frame, wherein said gate frame comprises at least a first and second fixing means (or first and second fastener) matching the catching means (or first and second catch) of the at least first and second latches and disposed such that, when the inlet orifice of the ladle shroud is inserted over the collector nozzle in said casting configuration, the fixing means (or fasteners) do not interfere with the catching means (or catches) of the latches when the latches are in their idle position such that the ladle shroud is free to move away from the collector nozzle along the longitudinal axis, and the catching means (or catches) of the at least first and second latches engage, or are configured to engage, in a reversible coupling relationship with the corresponding fixing means (or fasteners) when they are in their fixing position, whereby the ladle shroud is reversibly coupled to the collector nozzle of the ladle.

In one embodiment, the catching means (or catches) of the latches comprise an opening and the fixing means (or fasteners) of the gate frame comprise a lug suitable for reversibly engaging, or configured to reversibly engage, into the opening upon pivoting of a corresponding latch from its idle position to its fixing position. Inversely, in a second embodiment, the catching means (or catches) of the latches comprise a lug extending transverse to the latch and the fixing means (or fasteners) of the gate frame comprise a recess or opening suitable for reversibly receiving, or configured to reversibly receive, the lug upon pivoting of a corresponding latch from its idle position to its fixing position.

The kit of parts of the present invention may also comprise a robot suitable for (or configured for):

(a) gripping, engaging and fixing the central opening of a coupling device over the inlet portion of a ladle shroud to form a ladle shroud assembly;

(b) moving the latches from their fixing position to their idle position and holding them in such idle position, (c) inserting the inlet orifice of the ladle shroud assembly over the collector nozzle in casting configuration, such that the ladle shroud bore is in alignment with the bore of the collector nozzle;

(d) allowing the latches to return from their idle position to their fixing position whereby engaging the catching means (or catches) of each latch in the corresponding fixing means (or fasteners) to couple the ladle shroud to the collector nozzle, (e) releasing the grip on the ladle shroud.

The robot preferably comprises means for moving the latches from their fixing position to their idle position selected from a pivoting finger or a piston, which are hydraulically driven for applying a force higher than, and in a direction opposite to the natural bias of the resilient means.

The present invention also concerns a method for reversibly coupling a ladle shroud to a collector nozzle of a ladle, said method comprising providing a kit of parts as defined above comprising both collector nozzle and robot and carrying out the following steps with the robot, (a) gripping, engaging and fixing the central opening of a coupling device as defined above over the inlet portion of a ladle shroud as defined above to form a ladle shroud assembly;

(b) moving the latches of the coupling device from their fixing position to their idle position and holding them in such idle position, (c) inserting the inlet orifice of the ladle shroud assembly over the collector nozzle in casting configuration, such that the ladle shroud bore is in alignment with the bore of the collector nozzle;

(d) allowing the latches to return from their idle position to their fixing position whereby engaging the catching means (or catches) of each latch in the corresponding fixing means to couple the ladle shroud to the collector nozzle, (e) releasing the grip on the ladle shroud.

The robot in the present method is preferably suitable for carrying out the following steps:

(a) gripping the ladle shroud coupled to the collector nozzle;

(b) moving the latches (32) from their fixing position to their idle position and holding them in such idle position to disengage the catching means (or catches) (33, 33*a*) of each latch from the corresponding fixing means (or fasteners) (31, 31*a*)

(c) withdrawing the ladle shroud from the collector nozzle.

BRIEF DESCRIPTION OF THE SEVERAL VIEWS OF THE DRAWINGS

For a fuller understanding of the nature of the present invention, reference is made to the following detailed description taken in conjunction with the accompanying drawings in which:

FIG. 15A shows a side view of a coupling device according to the present invention.

FIG. 15B shows a side view of a coupling device according to the present invention.

FIG. 15C shows a side view of a ladle shroud according to the present invention.

FIG. 15D shows a step in a top view sequence of insertion and rotation of a coupling device with respect to a ladle shroud.

FIG. 15E shows a step in a top view sequence of insertion and rotation of a coupling device with respect to a ladle shroud.

FIG. 15F shows a step in a top view sequence of insertion and rotation of a coupling device with respect to a ladle shroud.

FIG. 15G shows a step in a top view sequence of insertion and rotation of a coupling device with respect to a ladle shroud.

FIG. 15H shows a step in a top view sequence of insertion and rotation of a coupling device with respect to a ladle shroud.

FIG. 15I shows a step in a top view sequence of insertion and rotation of a coupling device with respect to a ladle shroud.

DETAILED DESCRIPTION OF THE INVENTION

Figure 1:
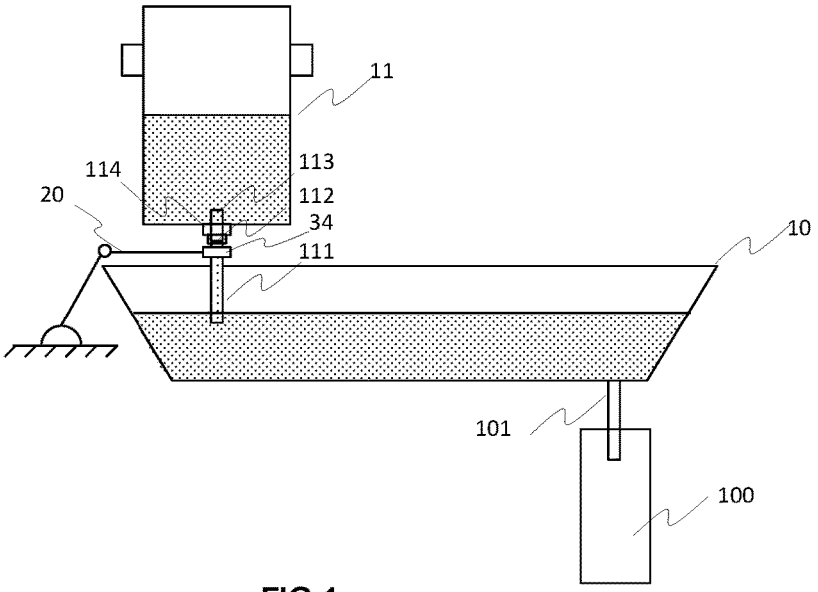
FIG. 1 represents a general view of a casting installation.
Figure 2:
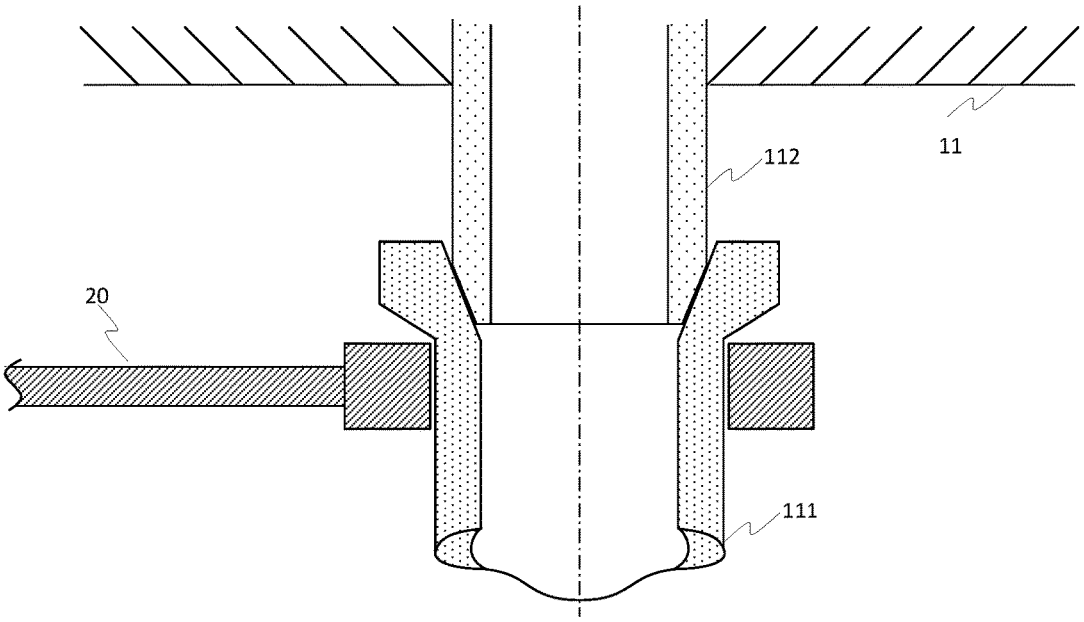
FIG.2 (PRIOR ART)
FIG. 2 shows a ladle shroud coupled to and held in casting configuration by means of a robot according to the prior art.
Figure 3A:
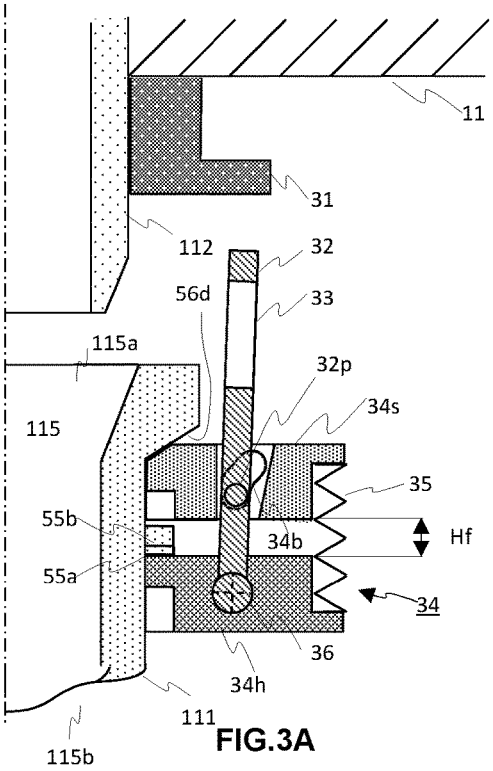
FIG. 3A shows a first embodiment of a ladle shroud with coupling device according to the present invention.
Figure 3B:
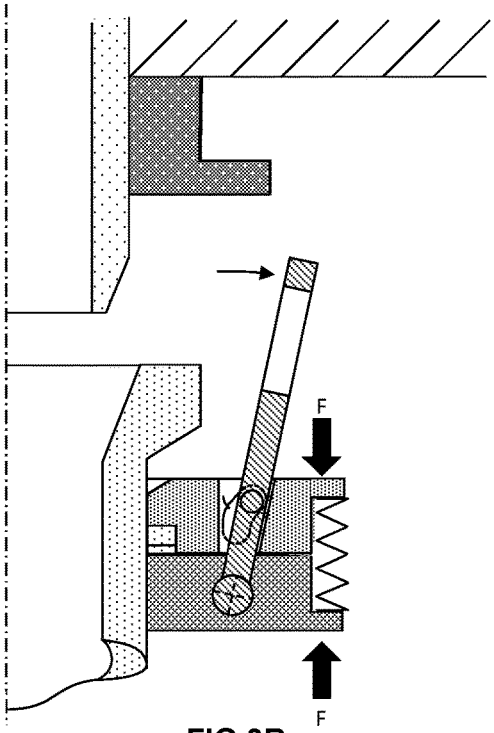
FIG. 3B shows a first embodiment of a ladle shroud with coupling device according to the present invention.
Figure 3C:
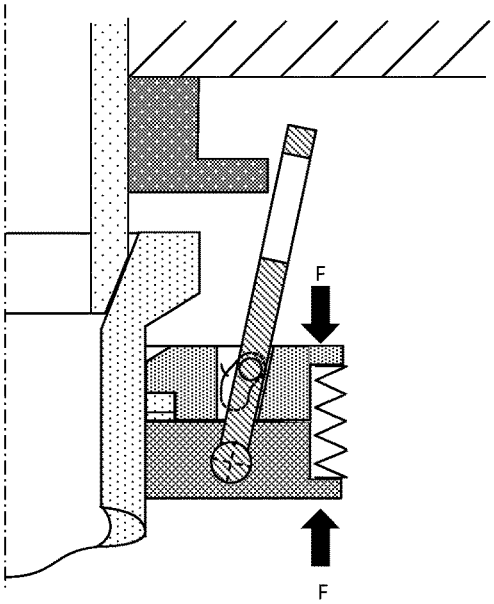
FIG. 3C shows a first embodiment of a ladle shroud with coupling device according to the present invention.
Figure 3D:
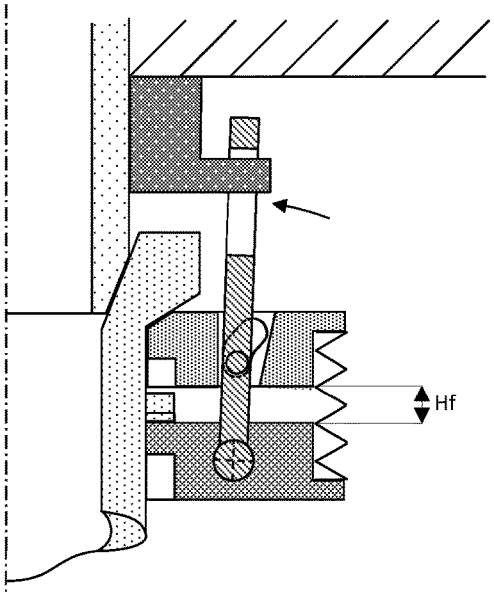
FIG. 3D shows a first embodiment of a ladle shroud with coupling device according to the present invention.
Figure 4A:
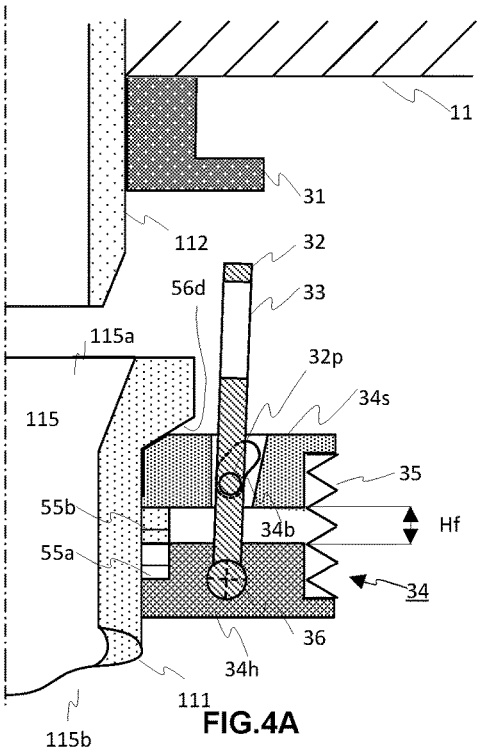
FIG. 4A shows a second embodiment of a ladle shroud with coupling device according to the present invention.
Figure 4B:
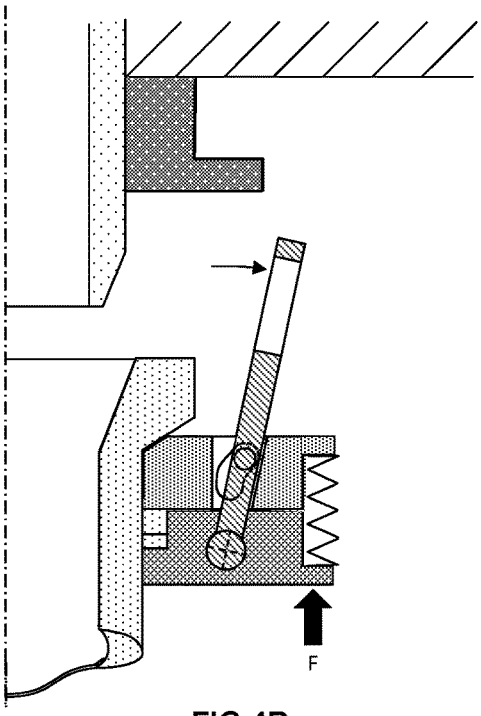
FIG. 4B shows a second embodiment of a ladle shroud with coupling device according to the present invention.
Figure 4C:
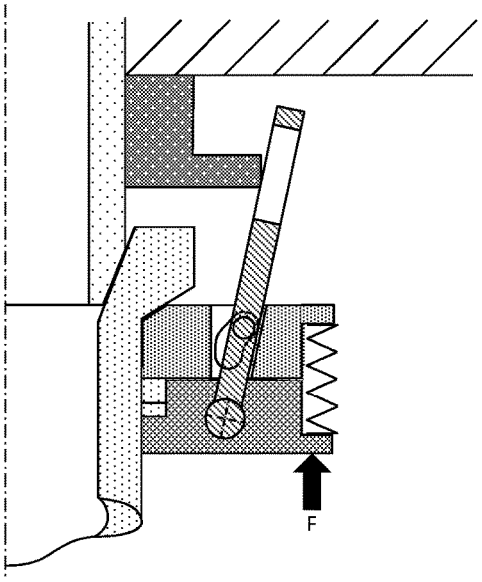
FIG. 4C shows a second embodiment of a ladle shroud with coupling device according to the present invention.
Figure 4D:
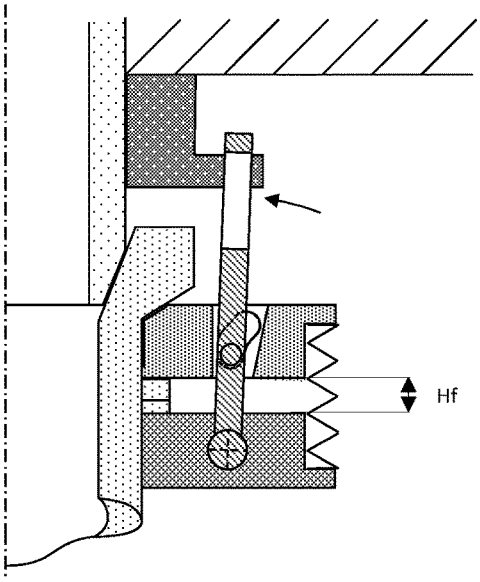
FIG. 4D shows a second embodiment of a ladle shroud with coupling device according to the present invention.
Figure 5A:
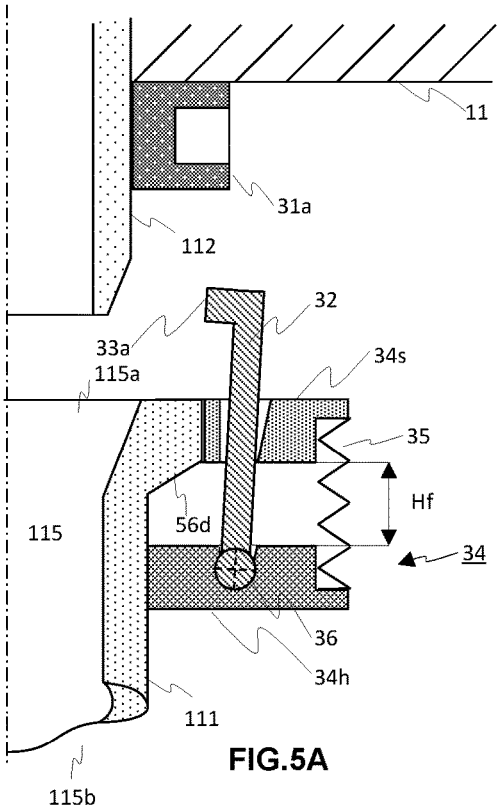
FIG. 5A shows a third embodiment of a ladle shroud with coupling device according to the present invention.
Figure 5B:
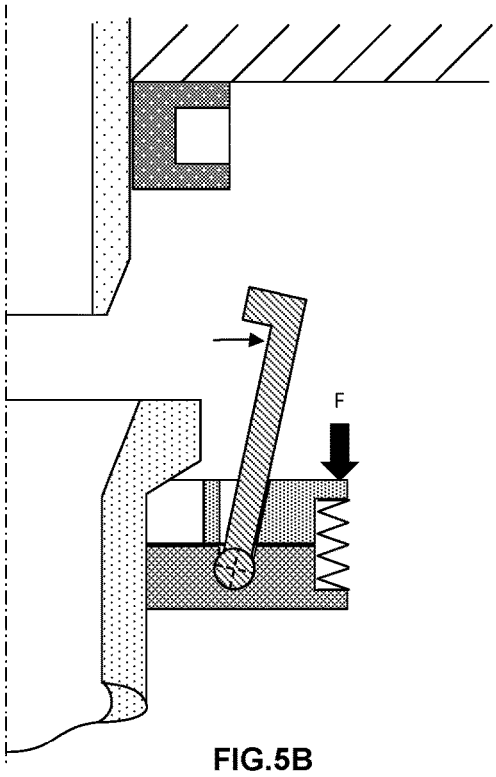
FIG. 5B shows a third embodiment of a ladle shroud with coupling device according to the present invention.
Figure 5C:
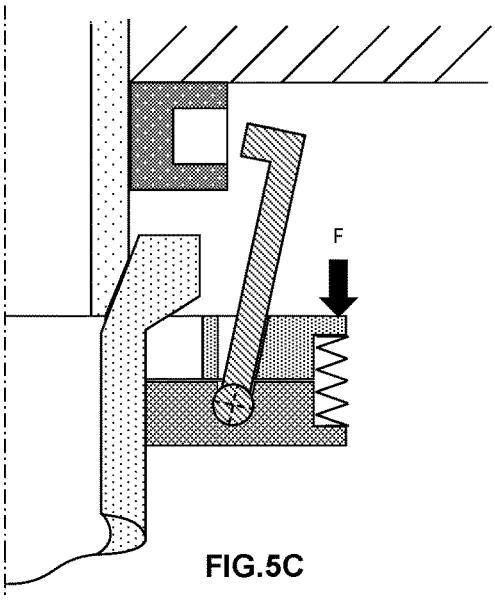
FIG. 5C shows a third embodiment of a ladle shroud with coupling device according to the present invention.
Figure 5D:
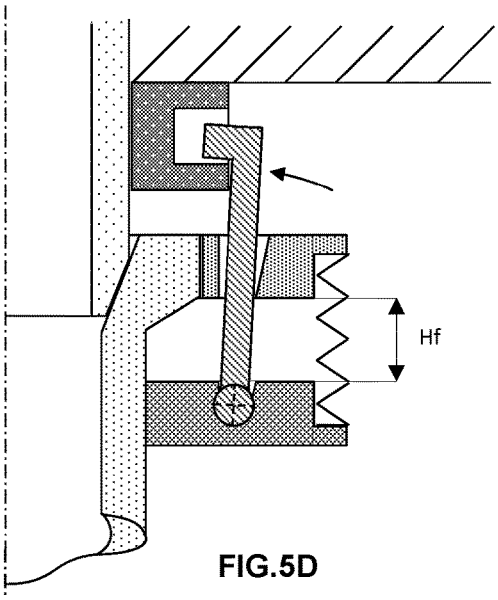
FIG. 5D shows a third embodiment of a ladle shroud with coupling device according to the present invention.
Figure 6A:
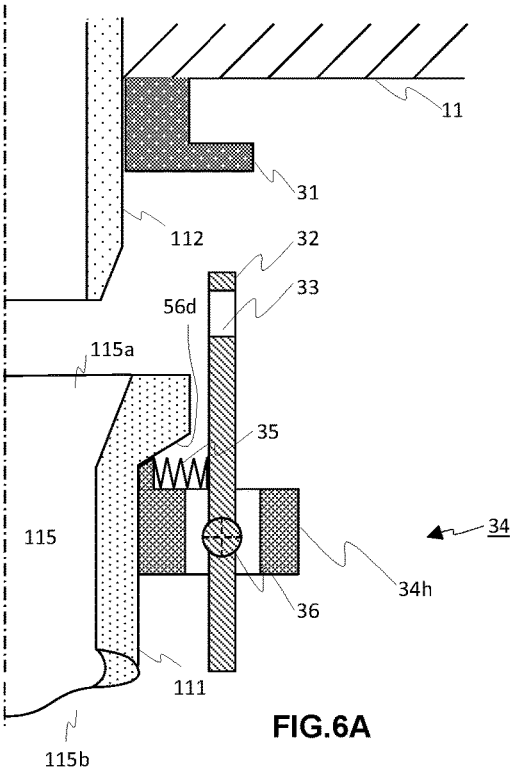
FIG. 6A shows a fourth embodiment of a ladle shroud with coupling device according to the present invention.
Figure 6B:
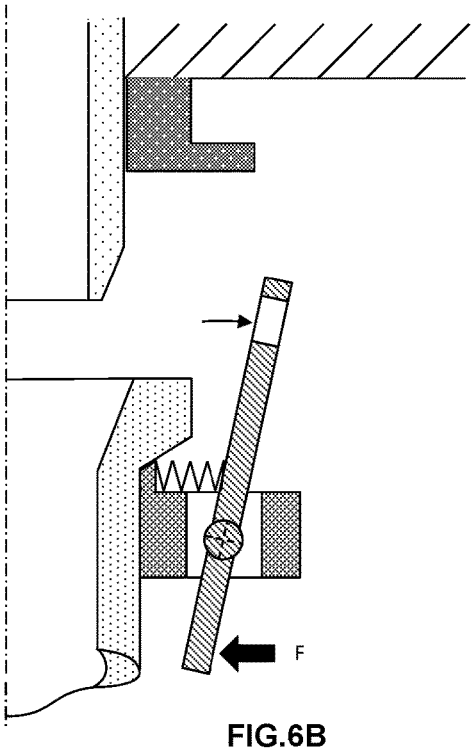
FIG. 6B shows a fourth embodiment of a ladle shroud with coupling device according to the present invention.
Figure 6C:
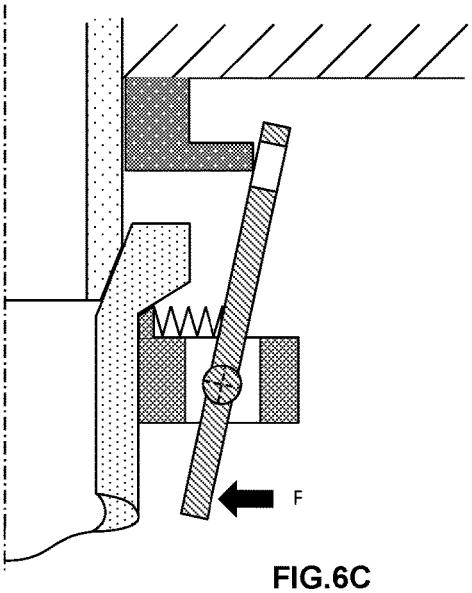
FIG. 6C shows a fourth embodiment of a ladle shroud with coupling device according to the present invention.
Figure 6D:
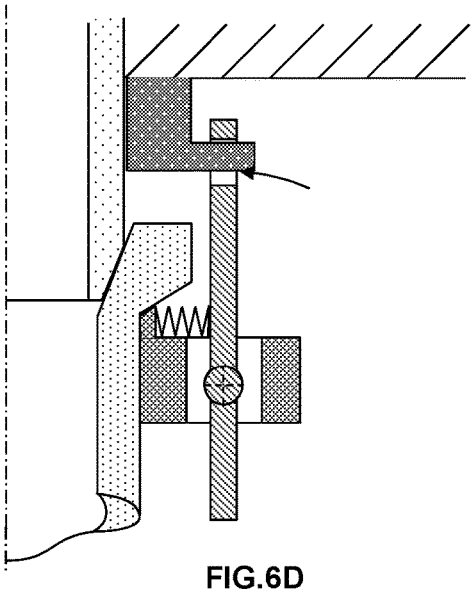
FIG. 6D shows a fourth embodiment of a ladle shroud with coupling device according to the present invention.
Figure 7A:
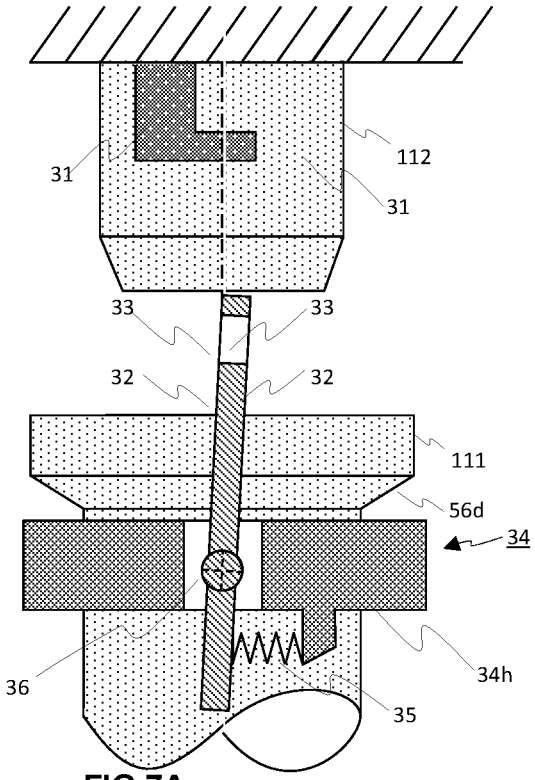
FIG. 7A shows a fifth embodiment of a ladle shroud with coupling device according to the present invention.
Figure 7B:
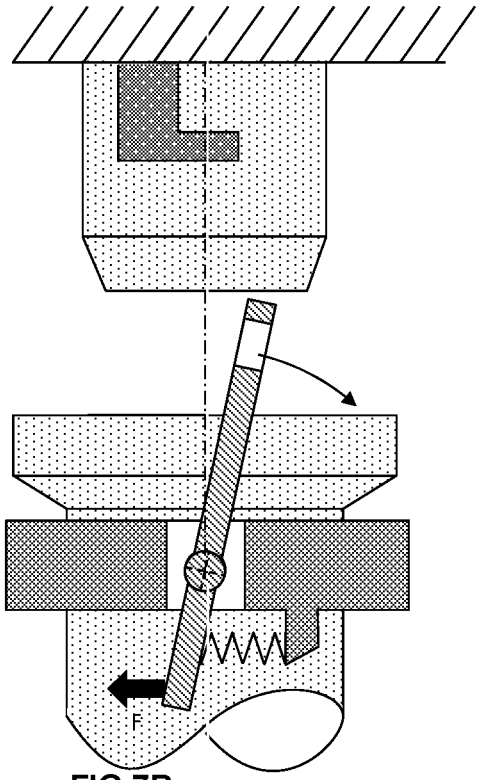
FIG. 7B shows a fifth embodiment of a ladle shroud with coupling device according to the present invention.
Figure 7C:
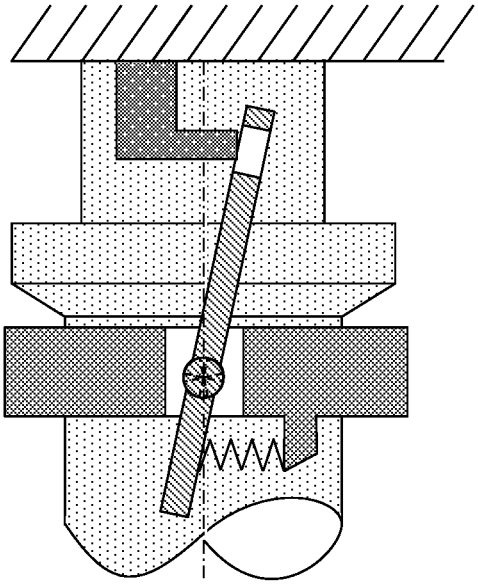
FIG. 7C shows a fifth embodiment of a ladle shroud with coupling device according to the present invention.
Figure 7D:
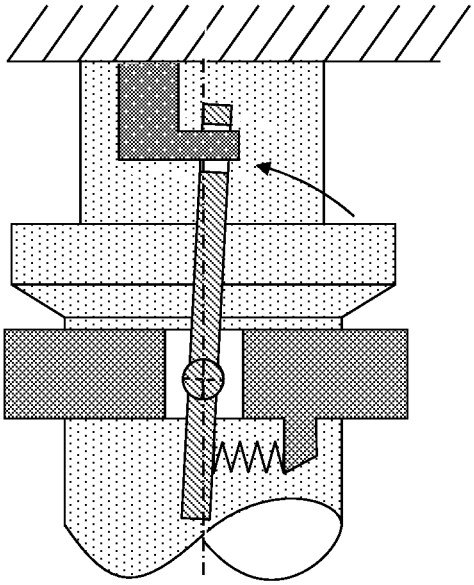
FIG. 7D shows a fifth embodiment of a ladle shroud with coupling device according to the present invention.
Figure 8A:
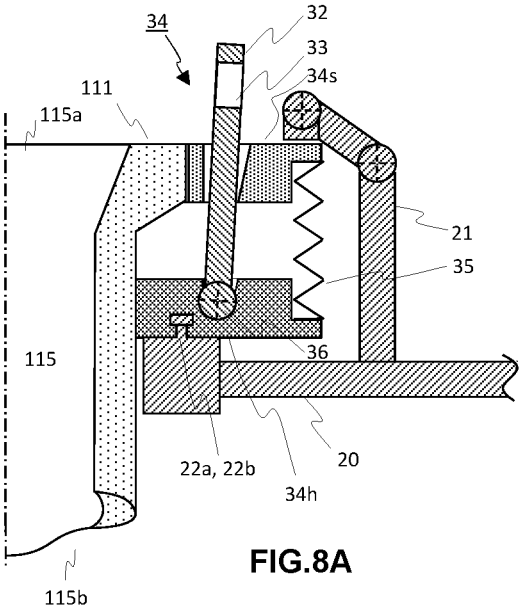
FIG. 8A shows means for actuating the latches of a coupling device according to the first embodiment.
Figure 8B:
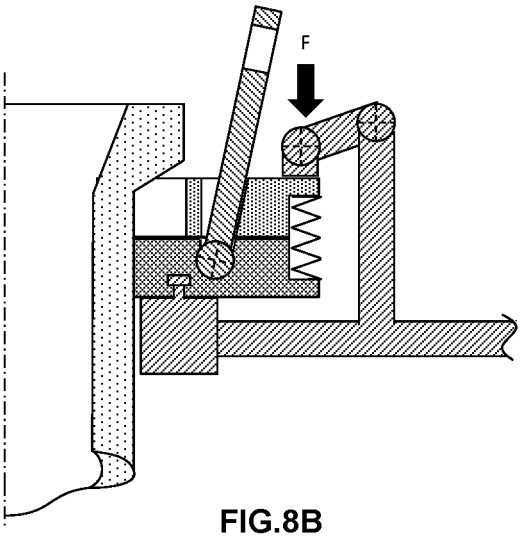
FIG. 8B shows means for actuating the latches of a coupling device according to the first embodiment.
Figure 9A:
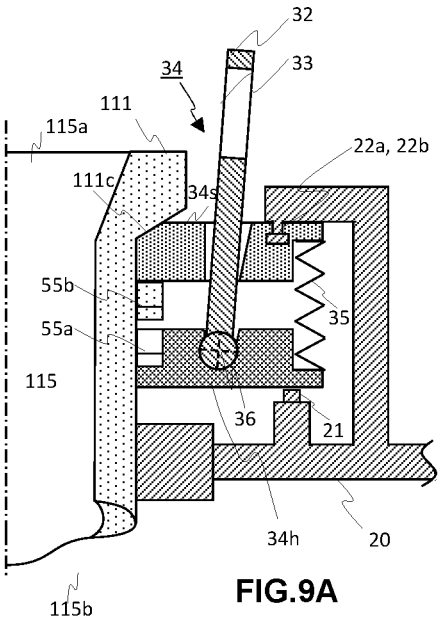
FIG. 9A shows means for actuating the latches of a coupling device according to the second embodiment.
Figure 9B:
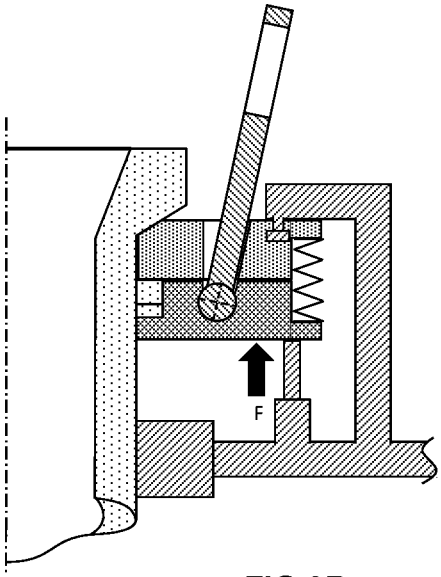
FIG. 9B shows means for actuating the latches of a coupling device according to the second embodiment.
Figure 10A:
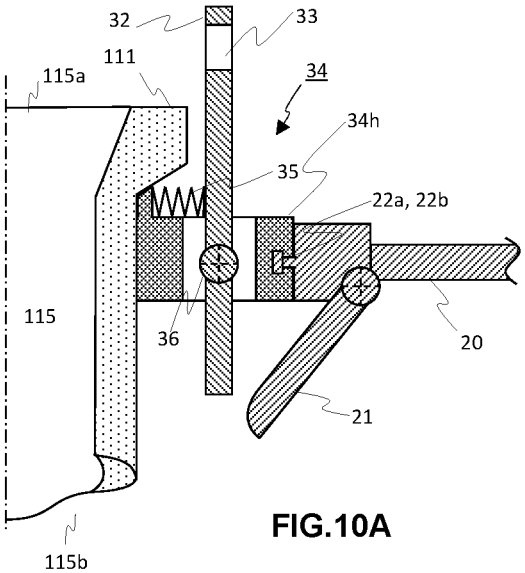
FIG. 10A shows means for actuating the latches of a coupling device according to the fourth embodiment.
Figure 10B:
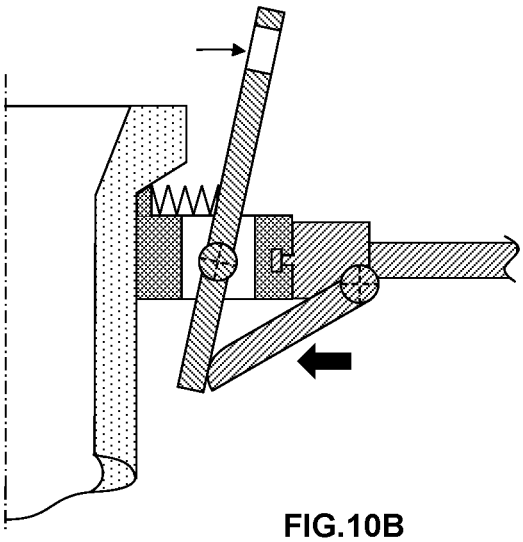
FIG. 10B shows means for actuating the latches of a coupling device according to the fourth embodiment.
Figure 11A:
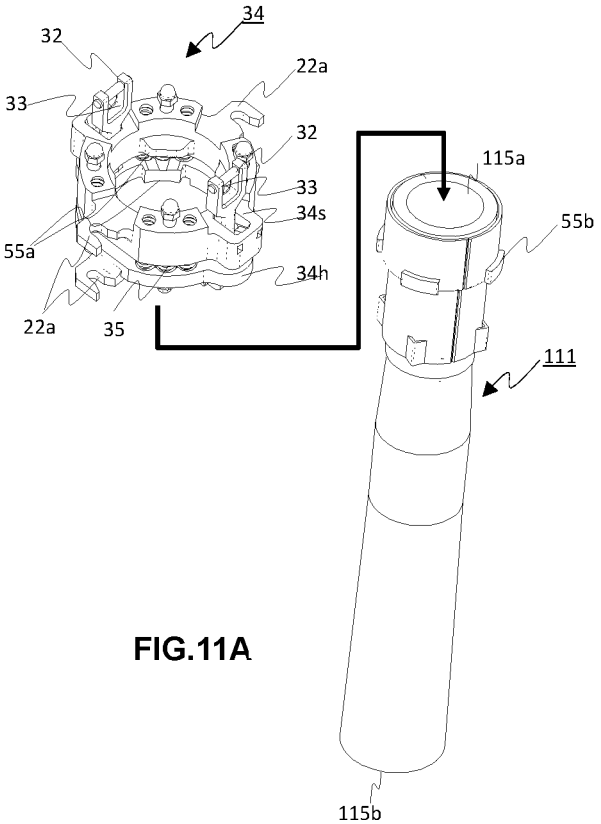
FIG. 11A shows a perspective view of a nozzle and coupling device according to the present invention separately.
Figure 11B:
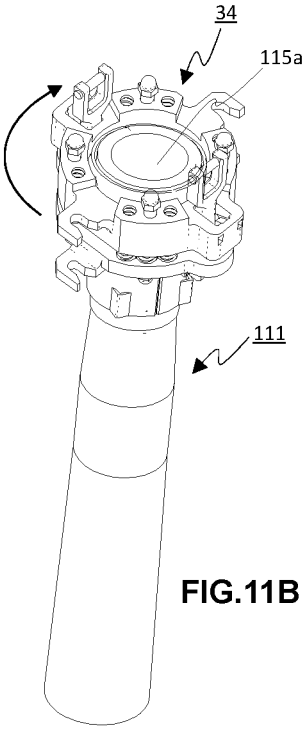
FIG. 11B shows a perspective view of a nozzle and coupling device according to the present invention fixed to one another.
Figure 12A:
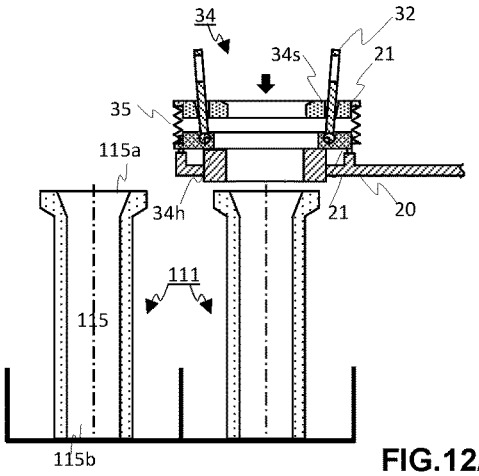
FIG. 12A illustrates a step in the coupling sequence of a ladle shroud with a coupling device according to the present invention to a collector nozzle of a ladle.
Figure 12B:
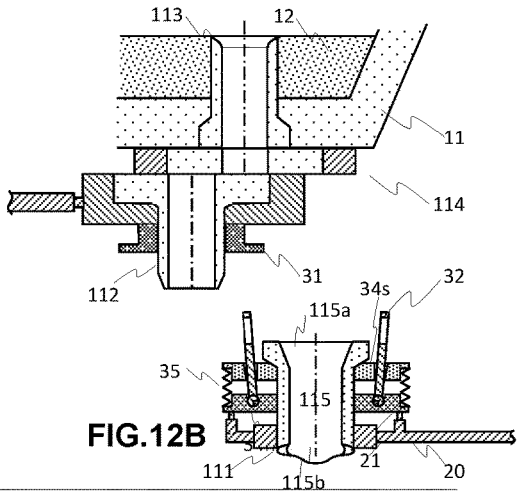
FIG. 12B illustrates a step in the coupling sequence of a ladle shroud with a coupling device according to the present invention to a collector nozzle of a ladle.
Figure 12C:
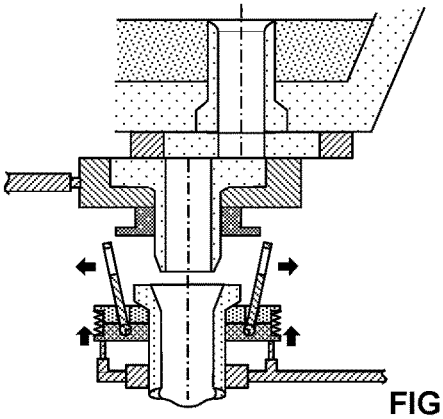
FIG. 12C illustrates a step in the coupling sequence of a ladle shroud with a coupling device according to the present invention to a collector nozzle of a ladle.
Figure 12D:
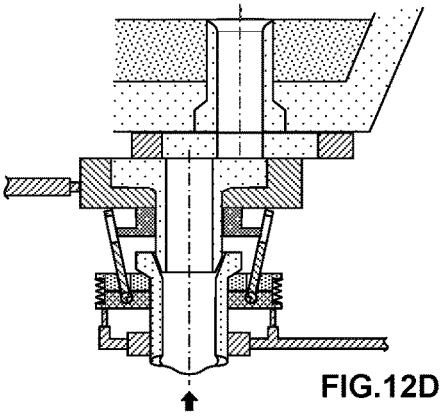
FIG. 12D illustrates a step in the coupling sequence of a ladle shroud with a coupling device according to the present invention to a collector nozzle of a ladle.
Figure 12E:
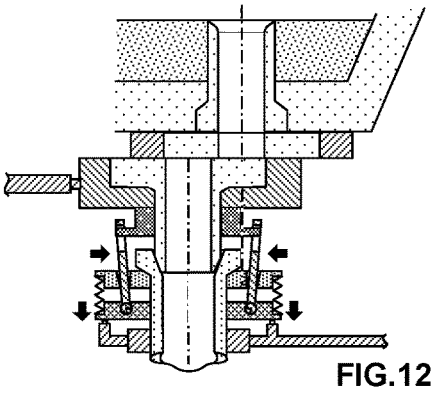
FIG. 12E illustrates a step in the coupling sequence of a ladle shroud with a coupling device according to the present invention to a collector nozzle of a ladle.
Figure 12F:
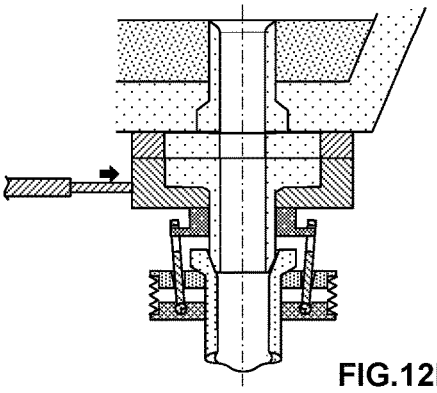
FIG. 12F illustrates a step in the coupling sequence of a ladle shroud with a coupling device according to the present invention to a collector nozzle of a ladle.

As illustrated in FIGS. 3A to 13B, the gist of the present invention is a coupling device (34) that can easily be fixed to a fresh ladle shroud (111) stored in a delivery rack (cf. FIGS. 11A, 11B and 12A). Said coupling device comprises catching means (33, 33*a*) suitable for reversibly engaging, or configured to reversibly engage, fixing means (31, 31*a*) provided in the gate frame coupling a collector nozzle to a ladle. The engagement of the catching means (33, 33*a*) into the fixing means (31, 31*a*) is only possible when the ladle shroud is in casting configuration with the outlet of the collector nozzle (112) sealingly encased in the inlet orifice of the ladle shroud. (cf; FIGS. 12D and 12E). Before describing the coupling device (34) in details, the ladle shroud (111) and ladle (11) are presented.

As shown in FIGS. 1, 12A, 12B, 12C, 12D, 12E and 12F, a ladle (11) is a large vessel comprising a bottom floor provided with an outlet aperture equipped with an inner nozzle (113) located inside the ladle and partly embedded in the refractory material (12) lining the interior of the ladle. A collector nozzle (112) is fixed to the outer side of the outlet aperture by a gate frame. The gate frame comprises a fixed plate in sealing contact with the inner nozzle and comprising a bore forming a continuous through bore with the inlet nozzle. The gate frame comprises a second, sliding plate (114) in sealing contact with the collector nozzle and comprising a bore forming a continuous through bore with the collector nozzle. The second, sliding plate (114) is slidingly movable with respect to the first, fixed plate, such as to bring the through bore formed by the sliding plate and collector nozzle in or out of registry with the through bore formed by the fixed plate and inner nozzle, thus allowing a control of the flow rate of metal through the inner nozzle and collector nozzle (112) (cf. FIGS. 12E and 12F). As explained in the introduction, a collector nozzle has a short tubular portion and a ladle shroud (111) is provided with a longer tubular portion and must be sealingly inserted over the collector nozzle in order to protect the liquid metal from any contact with air between the ladle and the tundish (10).

A ladle shroud (111) according to the present invention is illustrated in FIGS. 11A, 11B, 14A, 14B, 14C and 14D. It is rather similar to state of the art ladle shrouds, in that it comprises:

(a) an inlet portion located at an upstream end of the nozzle and comprising:
  i) an upstream surface normal to a longitudinal axis, X1, and defining an upstream perimeter, said upstream surface being provided with an inlet orifice (115*a*) suitable for snugly fitting, or configured to snugly fit, a collector nozzle (112) coupled to a ladle (11); and
  ii) a peripheral wall surrounding said upstream perimeter and extending along said longitudinal axis, X1, said peripheral wall being at least partially lined with a metal can (111*m*),
(b) a tubular portion extending along said longitudinal axis, X1, from said inlet portion to a downstream end, opposite the upstream end, and where an outlet orifice (115*b*) is located,
(c) a bore (115) extending parallel to the longitudinal axis, X1, from said inlet orifice (115*a*) to said outlet orifice (115*b*).

Figure 14A:
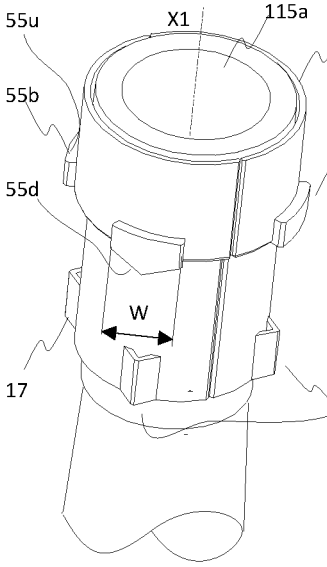
FIG. 14A shows an embodiment of a ladle shroud according to the present invention.
Figure 14B:
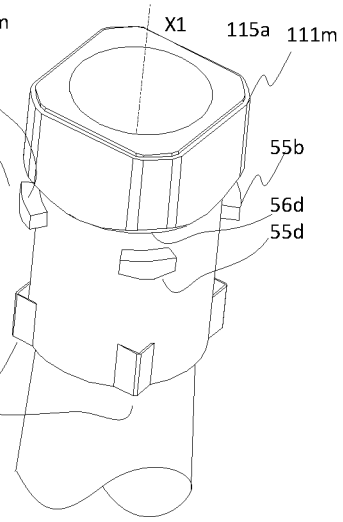
FIG. 14B shows an embodiment of a ladle shroud according to the present invention.
Figure 14C:
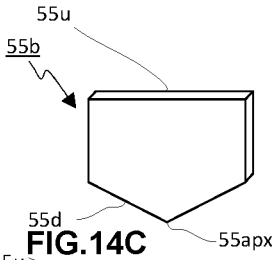
FIG. 14C shows an embodiment of a device connecting means according to the present invention.
Figure 14D:
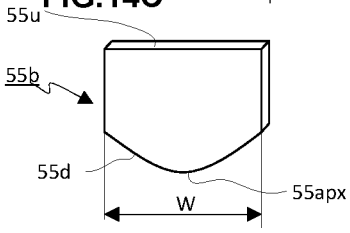
FIG. 14D shows an embodiment of a device connecting means according to the present invention.

It differs, however, from state of the art ladle shrouds in that it further comprises device connecting means (or shroud-to-coupling-device connector) (55*b*) for connecting with the shroud connecting means (or coupling-device-to-shroud connector) (55*a*) of the coupling device in a manner that will be explained more in details in the following. Said device connecting means are in the form of at least a first and a second discrete protrusions (55*b*), which are part of the metal can (111*m*) and are evenly distributed around the perimeter of the peripheral wall (cf. FIGS. 14A and 14B). Each of said at least first and second protrusions has a width, W, in the direction tangential to the peripheral wall and normal to the longitudinal axis, X1, and a depth, d, in the radial direction normal to the width, W, and to the longitudinal axis, X1, such that d/W<1, and defines an upstream ledge (55*u*), facing the direction of the upstream end of the ladle shroud, and a downstream ledge (55*d*), facing the direction of the downstream end of the ladle shroud, wherein the downstream ledge is convex with an apex (55*apx*) facing towards the downstream end of the ladle shroud and is located in the middle of, or substantially in the middle of, the protrusion's width. The downstream ledge (55*d*) can be in the shape of a chevron or of a circular arc as shown in FIGS. 14C and 14D.

As shown in FIGS. 3A to 10B, and 14D, it is preferred that the peripheral wall of the ladle shroud comprises a trunconical recess (56*d*), the small diameter thereof being oriented towards the downstream end of the ladle shroud, thus forming an inverted shoulder.

The coupling device (34) comprises a hinge frame (34*h*) having a central opening normal to a longitudinal axis, X1, passing through the centroid of said opening. The opening must be suitable for receiving a ladle shroud as defined above. The coupling device (34) can be fixed to a ladle shroud (111) by means of shroud connecting means (55*a*) suitable for interacting with device connecting means (55*b*) provided on said ladle shroud. For example, the shroud connecting means (55*a*) of the coupling device may be fixed to the device connecting means (55*b*) of the ladle shroud by rotation of one with respect to the other. An example is illustrated in FIGS. 15A to 15I which will be discussed more in details in the following. This embodiment may also include for example connecting means of the bayonet type, which can be advantageous for some embodiments of the present application.

At least two catching means (33, 33*a*) are required for reversibly coupling the ladle shroud (111) (with coupling device (34) fixed thereto) to the fixing means (31, 31*a*) coupled to the ladle through a gate frame, which is the frame holding the collector nozzle and encasing a gate mechanism. Gate mechanisms, either a slide gate or a rotating gate, are well known in the art and need not be explained in details here. They serve to control the flow rate of liquid metal flowing out of the ladle by sliding two plates provided with a bore, bringing the bore of each plate in and out of registry with respect to one another. An example of slide gate (114) is schematically illustrated in FIGS. 12A to 12F, wherein the gate is closed in steps (a) to (e), as the ladle shroud is being coupled to the collector nozzle, and is open in step (f) wherein the ladle shroud in fixed in its casting configuration. Each catching means (33, 33*a*) is provided on at least a first and second elongated latches (32) comprising a distal end and a proximal end. Each latch (32) is pivotally mounted on a hinge (36). The hinge (36) is mounted on the hinge frame (34*h*) and is coupled to a corresponding latch at a level closer to the distal end than to the proximal end thereof, whilst the catching means (33, 33*a*) is located closer to the proximal end than to the distal end of the latch. Each latch can be pivoted about the corresponding hinge from a fixing position to an idle position. Each latch is coupled, directly or indirectly to resilient means (35) naturally biased to drive said latch to its fixing position. The resilient means can be any type of spring, such as a coil spring, torsion spring, leaf spring, volute spring, and the like, as long as it can develop sufficient spring force for repeatedly driving the latches towards their fixing position when out of said position. The spring force developed by the resilient means should be lower than the force that can be applied, e.g., by a robot (20, 21) to the coupling device to drive the latches out of their fixing position, towards their idle position. One end of the resilient means can be coupled directly to the latches (32), whilst the other end is fixed to the hinge frame (34*h*), as for example illustrated in FIGS. 6A to 6D, 7A to 7D, and 10A and 10B. Alternatively, the resilient means can be coupled indirectly to the latches, and yet still naturally driving them towards their fixing position, by e.g., fixing one end to the hinge frame (34*h*) and the other end to a structure interacting with the latches, as illustrated in FIGS. 3A to 5D, 8A, 8B, 9A, 9B and 12A to 12F, wherein said structure is a slot frame (34*s*) which interaction with the latches will be discussed more in details below.

Figure 13A:
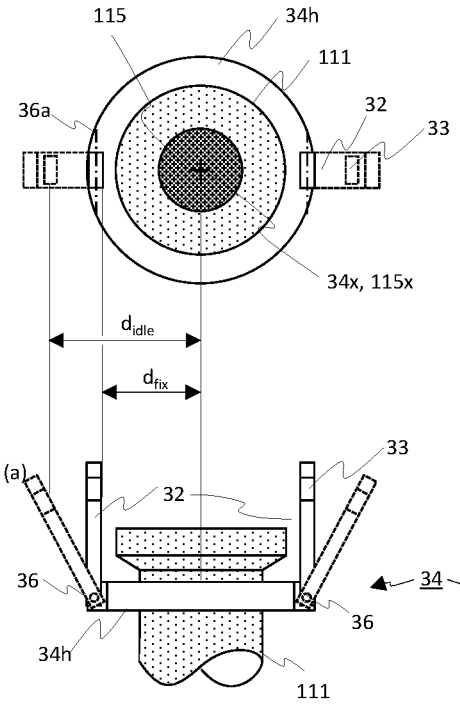
FIG. 13A illustrates the distance reduction between catching means and centroid of the central opening, when the latches are brought from their respective idle position to their fixing position.
Figure 13B:
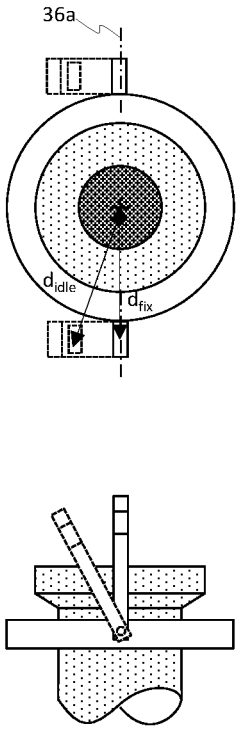
FIG. 13B illustrates the distance reduction between catching means and centroid of the central opening, when the latches are brought from their respective idle position to their fixing position.

The latches (32) are pivotally mounted on the hinge frame, such that the pivoting of any one of the at least first and second latches (32) about its respective hinge (36) from its respective idle position to its respective fixing position reduces the distance separating the catching means (33, 33*a*) thereof from the centroid of the central opening of the coupling device. FIGS. 13A and 13B compare the distance between the central opening and the catching means of latches (32) in idle position, dale, (dashed lines) and in fixing position, $d_{fix}$, (solid line) for two embodiments wherein the hinge axles (36*a*) (represented by a mixed line) are (a) normal to, and (b) parallel to the radius extending from the centre of said axle to the centroid of the central opening (and of the bore (115) of the ladle shroud when coupled to the coupling device). It can be seen that by pivoting from the respective idle position of the latches (32) to their respective fixing position, the distance of the two catching means to the centroid of the central opening is reduced from a distance, $d_{idle}$, to a distance $d_{fix}<d_{idle}$.

The catching means, which are located closer to the proximal end of each latch, can have different geometries. In particular, they can be in the form of an opening (33) suitable, upon pivoting from the idle position to the fixing position, for reversibly engaging a corresponding lug or hook (31) forming the fixing means of the gate frame, which holds the ladle gate mechanism and collector nozzle. This embodiment is schematically represented in FIGS. 3A to 3D, 4A to 4D, 6A to 6D, 7A to 7D, 12A to 12F, and 13A to 13B, as well as in the perspective view of FIGS. 11A and 11B. Alternatively, the catching means can be in the form of a lug or hook (33*a*) suitable, upon pivoting of each latch from their idle position to their fixing position, for reversibly engaging into an opening forming the fixing means (31*a*) of the gate frame. This embodiment is schematically represented in FIGS. 5A to 5D.

In a preferred embodiment, the hinge axle (36*a*) of each latch is normal to, or substantially normal to, a radius extending from the middle of the axle (36*a*) to the centroid of the inlet orifice (115*a*) when the coupling device (34) is fixed to a ladle shroud (111). This geometry allows the pivoting of each latch (32) within a plane defined by the longitudinal axis, X1, and said radius. For example, FIG. 13(*a*) illustrates such embodiment, allowing a pivoting which can be defined as a "radial" or a "converging" pivoting. Alternatively, the axle (36*a*) of each latch (32) can be parallel to a radius extending from the middle of the axle (36*a*) to the centroid of the inlet orifice (115*a*) when the coupling device (34) is fixed to a ladle shroud (111). This geometry, illustrated in 7A to 17D, and 13B, allows a pivoting which can be defined as a "tangential" pivoting. A converging pivoting is, however, preferred.

In an embodiment illustrated in FIGS. 3A to 5D, 15A, and 15B, wherein the pivoting is converging, the hinge (36) of each latch (32) is located adjacent to, or at the distal end of the corresponding latch (32). The coupling device comprises a second frame, referred to as the slot frame (34*s*), which can be moved towards and away from the hinge frame (34*h*) along a direction parallel to the longitudinal axis, X1, such as to vary the distance separating it from the hinge frame (34*s*), and which comprises one slot for each latch. Each latch is inserted in a corresponding slot which is free to move along the length of the latch between the hinge and catching means thereof. The geometry of the slots is such that upon displacement along a direction parallel to the longitudinal axis, X1, of the slot frame (34*s*) relative to the hinge frame (34*h*), each slot runs along the length of the corresponding latch and drives the tilting thereof from its idle to its fixing position. In particular, each slot may comprise one wall which is slanted with respect to the longitudinal axis, X1, and on which a latch rests. Upon moving the slot frame along the longitudinal direction, said slanted wall forces the angular pivoting of the latch. Alternatively to, or concomitantly with such slanted wall, in a most preferred embodiment illustrated in FIGS. 3A to 3D and 4A to 4D, each latch comprises at least one pin (32*p*) (preferably two) extending parallel to the hinge axle (36*a*) and protruding out of one side (preferably two) of the latch between the corresponding hinge (36) and catching means (33, 33*a*). Said pin is engaged in a bean shaped channel (34*b*) provided on wall of the corresponding slot, said wall being normal to the hinge axle (36*a*). The moving of the slot frame with respect to the hinge frame along the longitudinal axis provokes the sliding of the pin along the bean shaped channel thus forcing the movement of the corresponding latch into the corresponding idle or fixing positions thereof. The pivoting of each latch from its fixing position to its idle position can be performed by:

(a) decreasing the distance between the slot frame (34*s*) and the hinge frame (34*h*) along the longitudinal direction, X1 (as illustrated in FIGS. 3A to 5D), by either,
  i) holding the hinge frame (34*h*) in a fixed position with respect to the ladle shroud (111) and moving the slot frame (34*s*) towards the hinge frame (cf. FIGS. 3A to 3D, and 5A to 5D),
  ii) holding the slot frame (34*s*) in a fixed position with respect to the ladle shroud (111) and moving the hinge frame (34*h*) towards the slot frame (cf. FIGS. 4A to 4D, and 12A to 12F), or
  iii) moving with respect to the ladle shroud (111) both hinge frame (34*h*) and slot frame (34*s*) towards one another (cf. FIG. 15(*a*)&(*b*));

(b) increasing the distance between the slot frame (34*s*) and the hinge frame (34*h*) along the longitudinal direction, X1 (not illustrated) by either:
  i) holding the hinge frame (34*h*) in a fixed position with respect to the ladle shroud (111) and moving the slot frame (34*s*) away from the hinge frame,
  ii) holding the slot frame (34*s*) in a fixed position with respect to the ladle shroud (111) and moving the hinge frame (34*h*) away from the slot frame, or
  iii) moving with respect to the ladle shroud (111) both hinge frame (34*h*) and slot frame (34*s*) away from one another;

In the embodiments described above, using a slot frame, it is preferred that the resilient means (35) have one end connected to the hinge frame (34*h*) and the other end to the slot frame (34*s*), such that the natural bias of the resilient means drives the two frames towards their respective positions corresponding to the fixing position of the latches (32). FIGS. 3A to 3D illustrates a most preferred embodiment of such geometry, wherein the fixing position of the latches corresponds to the slot frame (34*s*) being furthest apart from the hinge frame (34*h*).

In the embodiment illustrated in FIGS. 3A to 3D, the hinges (36) are located at the distal end of the latches (32) and the latches are engaged in corresponding slots provided in a slot frame (34*s*) which can move towards and away from the hinge frame (34*h*) thus sliding the slots along the length of the corresponding latches engaged therein. Resilient means (35) represented as coil springs, are biased such as to move the slot frame (34*s*) and hinge frame (34*h*) away from each other. It follows that in the absence of any external forces, the hinge frame (34*h*) and slot frame (34*s*) are separated by a certain distance, $H_f$, and the latches must be at their fixing position. Upon application of a compressive force higher than the spring force of the resilient means (35) between the hinge frame (34*h*) and slot frame (34*s*), the distance between the two frames is decreased and the latches must pivot towards their idle position. This is performed as follows.

The outer wall of the slots is slanted such that each slot is narrower on the side facing the hinge frame, than on the opposite side, facing the ladle. This geometry allows the pivoting of the latches (32) about their respective hinges (36) such as:

- to decrease the angle they form with the longitudinal axis, X1, towards their fixing position when the hinge frame (34*h*) and slot frame (34*s*) are separated from one another until the distance between them reaches, $H_f$, and
- to increase the angle they form with the longitudinal axis, X1, towards their idle position when the hinge frame (34*h*) and slot frame (34*s*) are moved towards one another to reduce the distance between them.

It is to be noted that it is preferred that the latches (32) further comprise a pin (32*p*) engaged in a bean shaped channel (34*b*) as discussed above and illustrated in FIGS. 3A to 4D, to more precisely and repeatedly drive the latches to and fro between their idle and fixing positions.

Upon applying a force, F, higher than the spring force of the resilient means (35) to drive the slot frame (34*s*) and hinge frame (34*h*) towards one another in the longitudinal direction, X1, the slots run down the respective latches engaged therein. Because of the slanted outer wall of the slots and of the pin (32*p*) engaged in the bean shaped channel (34*b*), the latches can pivot about their respective hinges (36) as the slot frame (34*s*) and hinge frame are progressively driven towards one another, until they reach their idle position, corresponding to the slot frame being closest to, preferably in contact with the hinge frame (34*h*) (cf. FIG. 3(*b*)). While maintaining the slot frame and hinge frame close together, and as the latches (32) are in their idle position, the ladle shroud can be inserted about the collector nozzle into their casting configuration, without the fixing means (31, 31*a*) of the gate frame interfering with the catching means (33, 33*a*) of the latches (cf. FIG. 3(*c*)).

When the ladle shroud is in its casting configuration, the latches can be pivoted from their idle position back to their fixing position whereby they engage with the matching fixing means of the gate frame, simply by releasing the force, F, applied on the slot frame (34*s*), which is then driven away from the hinge frame (34*h*) by the action of the spring force of the resilient means (35). The ladle shroud is thus solidly and reversibly coupled to the collector nozzle without need of any robot (20) or the like to hold its casting configuration during the whole casting operation of the ladle (cf. FIG. 3(*d*)).

To unload the ladle shroud prior to moving the empty ladle away from its casting position, the catching means (33, 33*a*) of the coupling device (34) are disengaged from the fixing means (31, 31*a*) of the gate frame by applying a force, F, on the slot frame (34*s*) as described above. The ladle shroud can then be removed from the collector nozzle by driving it downwards along the longitudinal axis, X1, and then away. The ladle can thus be removed without hindrance from the long ladle shroud hanging below the ladle.

The embodiment illustrated in FIGS. 3A to 3D is particularly preferred to for the way the coupling device is coupled to the ladle shroud. First, the hinge frame (34*h*) comprises a concave upstream ledge (55*a*) of geometry matching the geometry of the convex downstream ledge of the protrusion (55*b*) of the ladle shroud (111) (said concave upstream ledge is not visible in FIGS. 3A to 3D because hidden by the downstream ledge of the protrusion resting thereupon). At this stage the ladle shroud rests upon the upstream ledge of the device connecting means (55*a*) of the coupling device. It is preferred that a portion of the peripheral wall of the ladle shroud forms trunconical recesses (56*d*) forming reversed shoulders. The slot frame then advantageously comprises trunconical upstream support ledges in which the trunconical recesses of the ladle shroud can snugly fit. In this case, the ladle shroud also rests on the trunconical upstream support ledges of the slot frame (34*s*) (cf. FIG. 3(*a*)). The slot frame also comprises a downstream ledge located vis-à-vis the upstream ledge (55*u*) of the protrusions (55*b*) of the ladle shroud and having a matching geometry therewith. Upon pressing the slot frame towards the hinge frame, the protrusions (55*b*) are clamped between the upstream ledges of the hinge frame (34*h*) and the downstream ledges of the slot frame (34*s*) like in the jaws of a vice (cf. FIG. 3(*b*)). At this stage, the ladle shroud (111) and coupling device (34) are solidly clamped together. Since at the same time, the latches have pivoted into their idle position, it is possible to insert the ladle shroud over the collector nozzle (112) into its casting position without interference between the catching means (33, 33*a*) of the coupling device and the fixing means (31, 31*a*) of the gate frame (cf. FIG. 3(*c*)). Then, releasing the compressive force applied onto the slot frame and hinge frame, the spring force drives them apart until they are separated by a distance, $H_f$, at which stage the catching means (33, 33*a*) of the coupling device have engaged with the fixing means (31, 31*a*) of the slide gate. At the same time, the downstream ledge of the slot frame (34*s*) separates from the protrusion (55*b*) of the ladle shroud, and the trunconical upstream support ledges of the slot frame nest snugly in the trunconical recesses of the ladle shroud. The ladle shroud (111) therefore rests both on the trunconical upstream support ledges of the slot frame (34*s*) and on the upstream ledges of the hinge frame (34*h*) giving the system great stability.

Because of, on the one hand, the trunconical geometry of the slot frame upstream support ledges (56*u*) and peripheral wall recesses (56*d*) and, on the other hand, the downstream ledges (55*d*) of the protrusions (55*b*) of the ladle shroud having a convex geometry matching the concave geometry of the upstream ledges of the hinge frame, the alignment of the ladle shroud (111) with the collector nozzle (112) can be made very easily since the ladle shroud and coupling device can adapt any misalignment of the system, thus ensuring in all cases a sealed contact between the collector nozzle and ladle shroud.

The control of the angular orientation about the longitudinal axis, X1, of the coupling device with respect to the ladle shroud (111) and later with respect to the fixing means (31, 31*a*) of the gate frame is essential to the success of the operation. One way to ensure that a robot (20) always positions the coupling device over the ladle shroud with the correct angular position, and then rotating it so that the protrusions (55*b*) of the ladle shroud are vis-à-vis the upstream ledge of the hinge frame (34*h*) (cf. FIGS. 15*a* to 15I) is to provide the robot with visual means (a camera) able to identify appropriate reference signs. An alternative, cheaper solution, is to provide the ladle shroud with several reference tabs (17) evenly distributed around a perimeter of the ladle shroud (preferably on the metal can (111*m*), which engage matching orientation indicators in the storing rack (not shown), thus ensuring that the ladle shrouds are always stored in a rack with a given orientation known to the robot.

The embodiment illustrated in FIGS. 4A to 4D differs from the one illustrated in FIGS. 3A to 3D and discussed above, in that the slot frame is fixed to the ladle shroud, and only the hinge frame is free to move along the longitudinal axis, X1, with respect to the slot frame and ladle shroud. When the latches (32) are in fixing position, the ladle shroud rests on the trunconical cavity of the slot frame, and not on the upstream ledges of the hinge frame (here represented at the bottom of a cavity). Upon application of a compressive force onto the hinge frame, the distance between hinge frame (34*h*) and slot frame (34*s*) decreases, until the protrusions (55*b*) of the ladle shroud are clamped between the upstream ledges of the hinge frame (34*h*) and the downstream ledges of the slot frame (34*s*). The coupling device (34) and ladle shroud are thus firmly clamped together. At the same time the latches (32) pivoted towards their idle position thus allowing the insertion of the ladle shroud over the collector nozzle in its casting configuration (cf. FIGS. 4B and 4C). Release of the force applied onto the hinge frame, drives the hinge frame away from the slot frame and engages the latches (32) into the fixing means (31) of the gate frame upon pivoting into their fixing position.

The embodiment illustrated in FIGS. 5A to 5D is similar to the one illustrated in FIGS. 3A to 3D and discussed supra, and differs therefrom in that (a) the catching means (33*a*) of the coupling device (34) are in the shape of a lug or hook, whilst the fixing means (31*a*) of the gate frame are in the form of an opening, and (b) the slot frame comprises no trunconical upstream support ledges on which the ladle shroud can rest. Otherwise, the principle is identical to the one described with respect to FIGS. 3A to 3D (the device and shroud connecting means (55*a*, 55*b*) are not represented for simplification of the Figures.

FIGS. 6A to 6D show an alternative embodiment, differing from the embodiments discussed above with reference to FIGS. 3A to 5D, in that it comprises no slot frame (34*s*), and in that the hinges (36) are located between the proximal end and the distal end of the corresponding latches, such that said latches can pivot in a see-saw mode from their fixing position to their idle position by application onto the distal end thereof of a force normal to both the hinge axle and the longitudinal axis, X1, and in the direction of the latter. In the absence of a slot frame allowing the clamping of the protrusions (55*b*), the connecting means between coupling device and ladle shroud are preferably a bayonet. The resilient means (35) are represented in FIGS. 6A to 6D as a coil spring, with one end fixed to the latch between the hinge and proximal end thereof, and the other end to the hinge frame (34*h*), but it is clear that it could be a torsion spring positioned in the hinges themselves. The latches can be pivoted to their idle position by application of a force on the distal end thereof, and pivoted back to their fixing position by releasing said force and letting the spring force of the biased resilient means act. As discussed with reference to the previous embodiments, the ladle shroud can be brought into casting position when the latches are in their idle position (cf. FIG. 6C) and fixed to the collector nozzle by pivoting the latches back into their fixing position thereby engaging the fixing means (31, 31*a*) of the gate frame (cf. FIG. 6D).

FIGS. 7A to 7D show yet another embodiment, differing from the embodiments discussed with reference to FIGS. 3A to 6D in that the axles (36*a*) of the hinges (36) are oriented parallel to the radius extending from the centre of the axle (36*a*) to the centroid of the bore (115) of the ladle shroud (111) (in the previous embodiments, the axles of the hinges were normal to said radius). The principle remains, however, very similar with the foregoing embodiments, in that the latches can be pivoted from their fixing position to their idle position by application of an appropriate force and returned to their fixing position by releasing said force and letting the resilient means act. FIGS. 7A to 7D show a system with no slot frame, equivalent to the embodiment of FIGS. 6A to 6D. It is clear that the pivoting of the latches can also be achieved with a slot frame (34*s*) moving with respect to the hinge frame and comprising slots and bean shaped channels (34*b*) as discussed with reference to FIGS. 3A to 5D.

Application of an external force, F, for driving the latches from their fixing position to their idle position can be carried out with the robot (20) used for bringing the ladle shroud into its casting position. For example and as illustrated in FIGS. 8A to 10B the robot may comprise means (21) for moving the latches (32) from their fixing position to their idle position. In FIGS. 8A, 8B, 10A and 10B, said means (21) comprise a pivoting finger and in FIGS. 9A and 9B they comprise a piston, which can be hydraulically or pneumatically driven. As discussed above, the external force applied by means (21) must be higher than the spring force of the resilient means to allow the pivoting of the latches. The coupling device (34) also comprises holding means (22*a*) suitable for allowing the robot gripping means (22*b*) to solidly hold and handle the coupling device.

As illustrated in FIGS. 11A and 11B, a coupling device (34) can be coupled to the inlet portion of a ladle shroud. For practical reasons, it is preferred that the coupling device (34) be inserted about the inlet portion of a ladle shroud from the top (upstream end) of the ladle shroud. Indeed, first it is easier for a robot (20) to engage the coupling device (34) from the top of a ladle shroud stored in a rack next to the casting installation. Second, for reasons of fluid mechanics, the tubular portion of ladle shrouds often has a varying cross section, diverging towards the outlet. Engaging the coupling device from the downstream end of the ladle shroud would require the central opening of the coupling device (34) to be larger than required by the dimensions of the inlet portion of the ladle shroud (111). FIGS. 15A and 15B show a side view of a coupling device according to the present invention according to the embodiment discussed above with reference to FIGS. 3A to 3D with the hinge frame (34*h*) (a) separated from the slot frame (34*s*) in its first position and the latches (32) in fixing position and (b) closer together with the slot frame (34*s*) in their second position with the latches in their idle position. By driving the hinge frame and slide frame closer together, the protrusions (55*b*) of the ladle shroud are clamped between the upstream ledges of the hinge frame (34*h*) and the downstream ledges of the slot frame (34*s*). It must be realised that gripping a coupling device (34) to a ladle shroud by bringing closer together two frames (34*h*, 34*s*) of the coupling device to clamp a protrusion (55*b*) of the ladle shroud is quite innovative even without the additional advantage that this action also triggers the pivoting of the latches from their fixing position to their idle position. Indeed, the pivoting can be triggered by an alternative action of the robot other than the driving closer together the two frames. FIG. 15(*c*) shows a top view of a ladle shroud of the type illustrated in FIGS. 14(*b*) and 15(*a*)&(b)). Therefore, according to another of its aspects, the invention concerns specifically such a ladle shroud and a gripping device adapted to grip it. The ladle shrouds of FIGS. 15A to 15I, and 14(*b*) differ from the one of FIG.

14(*a*) in that the upstream perimeter is in the shape of a square with four broken (rounded) corners. At the level of the four broken corners, the peripheral wall extends straight down towards the downstream end of the ladle shroud until it forms four recessed trunconical portions (56*d*). These are aligned directly upstream from the protrusions (55*b*) along the direction, X1.

The distance, D55*a*, separating the upstream ledges of the shroud connecting means (55*a*) and the distance, D56*u*, separating the trunconical upstream support ledges (56*u*) of the coupling device (34) are both larger than the bimedians, Dm, (=segment connecting the midpoints of two opposed sides) of the square upstream perimeter of the ladle shroud. This allows the coupling device (34) to be inserted over the inlet portion of the ladle shroud (111) when the angular orientation of the ladle shroud (111) is such as illustrated in FIGS. 15D and 15G with the upstream ledges of the shroud connecting means (55*a*) and the trunconical upstream support ledges (56*u*) of the coupling device (34) being vis-à-vis the straight sides of the square upstream perimeter.

Inversely, the distance, D55*a*, separating the upstream ledges of the shroud connecting means (55*a*) and the distance, D56*u*, separating the trunconical upstream support ledges (56*u*) of the coupling device (34) are both larger than the diameters, D55*b*, D56*d*, of the circles circumscribing the protrusions (55*b*) and the downstream trunconical recessed portions (56*d*) of the ladle shroud, respectively. This means that by rotation of 45° of the coupling device with respect to the ladle shroud, the coupling device can be coupled to the ladle shroud as illustrated in Figures FIGS. 15F and 15I. The angle of 45° applies to the specific geometry of the embodiment illustrated in FIGS. 15A to 15I and it is clear that other angles of rotation would apply with different geometries and protrusions distributions around the peripheral wall of the ladle shroud.

The series of FIGS. 15D, 15E and 15F shows a top view sequence of insertion and rotation of the coupling device with respect to the ladle shroud (111), showing the hinge frame (34*h*) and the series (a2) to (c2) illustrates the same sequence but with reference to the slot frame (34*s*).

After inserting the coupling device (34) appropriately oriented and at the specified depth along the longitudinal axis, X1, over the ladle shroud (111) (cf. FIGS. 15E and 15H), it is rotated about the longitudinal axis, X1, in order to bring the upstream ledges of the connecting means (55*a*) of the coupling device below and vis-à-vis the downstream ledges (55*d*) of the corresponding protrusions (55*b*) of the ladle shroud (cf. FIG. 15F). The recessed trunconical portions (56*d*) of the peripheral wall of the ladle shroud (111) are also brought into registry with the corresponding trunconical upstream support ledges (56*u*) by said rotation as shown in FIG. 15I.

A main advantage of the present invention is that a single coupling device (34) can be used several (hundreds of) times to couple different ladle shrouds (111) to several ladles (11) for casting several corresponding batches of liquid metal in a tundish or the like. After a ladle is empty and ready to be removed from its casting position, a robot (20) holds the coupling device (34) fixed to the ladle shroud (111) which has been used for emptying said ladle, pivots the catching means (33, 33*a*) from their fixing position to their idle position as explained above, removes the ladle shroud (111) by pulling it down along the longitudinal axis away from the collector nozzle and ladle, and travels to deposit it into a dispensing rack, whence the coupling device is removed from the spent ladle shroud (111). The robot, still holding the coupling device (34), now without any ladle shroud, brings it to a store rack where several fresh ladle shrouds (111) are stored and fixes the coupling device (34) to a fresh ladle shroud (111) (cf. FIG. 12(*a*)). After engagement of the coupling device (34) over a fresh ladle (111), the two can be fixed together by actuating the shroud connecting means (55*a*) and device connecting means (55*b*), typically by rotation of one with respect to the other as explained above or with a bayonet type connecting means. In order to allow the robot to perform all the foregoing operations with the coupling device (34) the latter must be provided with holding means (22*a*) which a robot can grip solidly. A person skilled in the art knows what holding means (22*a*) are necessary for a given model of robot and it is not necessary to dwell on the details thereof as they do not affect the present invention. In FIGS. 11A and 11B, the holding means (22*a*) are represented as hooks provided at diametrically opposed positions of both hinge frame (34*h*) and slot frame (34*s*). Any other means known to a person skilled in the art allowing a robot to solidly hold the coupling device are, however, suitable for and do not affect the present invention.

Once the coupling device is solidly fixed to a fresh ladle shroud (111), the robot brings the ladle shroud and coupling device into casting configuration by engaging the ladle shroud over a collector nozzle by first pivoting the latches (32) from their fixation position to their idle position as discussed above and as illustrated in FIGS. 12B to 12D. Note that during all this time the gate (114) controlling the flow of liquid metal out of the ladle is in a closed position, to prevent any liquid metal spilling on the robot (20) and coupling device (34). Once in casting configuration, the latches (32) are pivoted back to their fixing position, thus engaging the catching means (33, 33*a*) thereof into the fixing means (31, 31*a*) of the gate frame, the robot removed and the gate opened to allow liquid metal to flow out of the ladle, through the continuous bore formed by the inner nozzle (113), the collector nozzle (112) and the ladle shroud (111) into a tundish or the like (cf. FIGS. 12E and 12F). The sliding or rotation of the gate plate from a closed to an open position is performed by a hydraulic arm, as is well known in the art, and needs not be described in details herein. When the ladle is empty, the robot (20) deposits the spent ladle shroud in an appropriate disposal rack where the coupling device is separated from the ladle shroud. The spent ladle shroud is either cleaned for re-use or disposed of. The robot then brings the coupling device (34) to a new ladle shroud (111) for coupling it to a new ladle as explained above and illustrated in FIGS. 12A to 12F.

Combining a coupling device (34) with appropriate ladle shrouds (111) and fixing means (31, 31*a*) provided in a gate frame is an optimal and inexpensive solution for the coupling of a ladle shroud to a ladle (11) without need of any external support means during the casting operation. Indeed, one coupling device (34) can be re-used hundreds of times for coupling many ladle shrouds to many ladles loaded with a fresh batch of molten metal. The ladle shrouds according to the present invention are not more expensive than prior art ladle shrouds since they only differ therefrom in that they comprise protrusions (55*b*) as defined above. The coupling device of the present invention is not bulky, and very easy to handle by state of the art robots (20).

Numerous modifications and variations of the present invention are possible. It is, therefore, to be understood that within the scope of the following claims, the invention may be practiced otherwise than as specifically described.

I claim:

1. Ladle shroud configured for use with a coupling device for reversibly coupling an inlet orifice of a ladle shroud to a collector nozzle fixed to an outside of a bottom floor of a ladle in a metal casting installation, said outside of the bottom floor of the ladle comprising a gate frame, said coupling device comprising:

a) a hinge frame having a central opening normal to a longitudinal axis, X1, passing through a centroid of said opening, and which is configured to receive a ladle shroud;

b) coupling device to shroud connector configured to connect said hinge frame to a ladle shroud inserted in said central opening;

c) at least a first and second elongated latch comprising a distal end and a proximal end, and wherein each corresponding latch of the at least first and second latches:

is pivotally mounted on a corresponding hinge at a level closer to the distal end than to the proximal end of the corresponding latch, said corresponding hinge being located on the hinge frame, such that the corresponding latch can pivot from a fixing position, wherein the coupling device is fixed to the ladle gate frame, to an idle position, wherein the coupling device is not fixed to the ladle gate frame, is coupled to a latch driver developing a force to drive said corresponding latch to its fixing position, is provided with a catch located closer to the proximal end than to the distal end of the corresponding latch, such that the pivoting of any one of the at least first and second latches about its corresponding hinge from its respective idle position to its respective fixing position reduces a distance separating the catch thereof from the centroid of the central opening;

said ladle shroud comprising:

a) an inlet portion located at an upstream end of the nozzle and comprising:

i) an upstream surface normal to a longitudinal axis, X1, and defining an upstream perimeter, said upstream surface being provided with an inlet orifice configured to snugly fit a collector nozzle coupled to a ladle; and ii) a peripheral wall surrounding said upstream perimeter and extending along said longitudinal axis, X1, said peripheral wall being at least partially lined with a metal can, b) a tubular portion extending along said longitudinal axis, X1, from said inlet portion to a downstream end, opposite the upstream end, and where an outlet orifice is located, c) a bore extending parallel to the longitudinal axis, X1, from said inlet orifice to said outlet orifice, wherein the ladle shroud further comprises a shroud-to-coupling-device connector for connecting with the coupling-device-to-shroud connector, said shroud-to-coupling-device connector being in a form of at least a first and a second discrete protrusions, which are part of the metal can and are evenly distributed around the perimeter of the peripheral wall, wherein each of said at least first and second protrusions has a width, W, in a direction tangential to the peripheral wall and normal to the longitudinal axis, X1, and a depth, d, in a radial direction normal to the width, W, and to the longitudinal axis, X1, such that $d/W<1$, and defines an upstream ledge, facing a direction of the upstream end of the ladle shroud, and a downstream ledge, facing a direction of the downstream end of the ladle shroud, wherein the downstream ledge is convex with an apex facing towards the downstream end of the ladle shroud and is located substantially in a middle of the protrusion's width;

wherein the downstream ledge is in a shape selected from the group consisting of a chevron and a circular arc.

* * * * *